United States Patent [19]

Fraser

[11] 4,090,312

[45] May 23, 1978

[54] FREEZE DRYER PARTICULARLY ADAPTED FOR FREEZE DRYING MATERIALS HAVING HIGHLY CORROSIVE VAPORS

[75] Inventor: Douglas S. Fraser, New Paltz, N.Y.

[73] Assignee: FTS Systems, Inc., Stone Ridge, N.Y.

[21] Appl. No.: 729,593

[22] Filed: Oct. 4, 1976

[51] Int. Cl.[2] ..... F26B 13/30

[52] U.S. Cl. ..... 34/92; 62/440

[58] Field of Search ..... 34/5, 92; 62/440

[56] References Cited

U.S. PATENT DOCUMENTS 2,539,943 1/1951 Breazeale ..... 34/92

OTHER PUBLICATIONS

Exhibit A, p. 463 of Fisher Catalogue 70 published in 1972.

*Primary Examiner*—John J. Camby

*Attorney, Agent, or Firm*—Robert E. Wagner; Gerald T. Shekleton

[57] ABSTRACT

A freeze dryer chemically resistant to corrosive condensates having a sample chamber in direct communication with the condenser chamber. The condenser chamber is spun-molded of a chemically resistant material having an exterior with a near perfect cylindrical shape, and is insulatedly supported on the frame by wooden blocks shaped to conform exactly with the chamber exterior, thereby strengthening the chamber walls to withstand the stress of the high vacuum and low temperatures. Visibility and accessibility to the entire condenser chamber is accomplished by easily removable front and rear transparent cover plates, the rear cover plate serving as a mounting for the condensing coil.

9 Claims, 7 Drawing Figures

FIG. 1
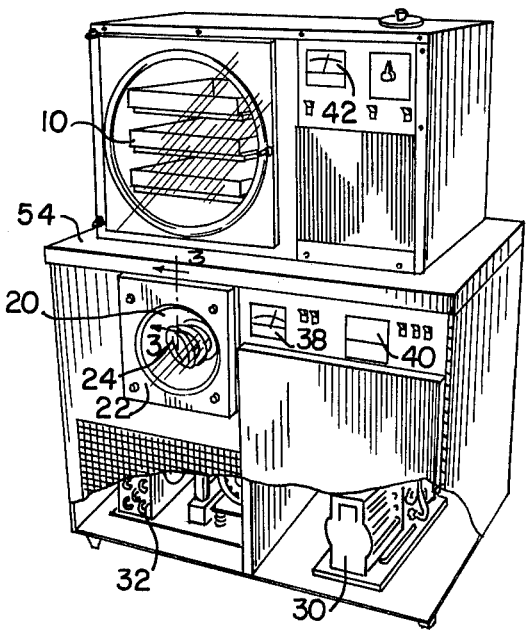
FIG. 5
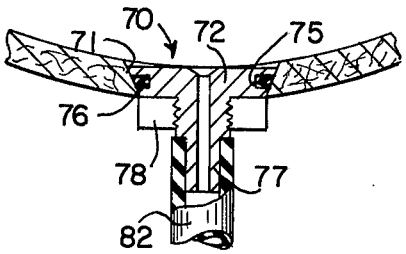
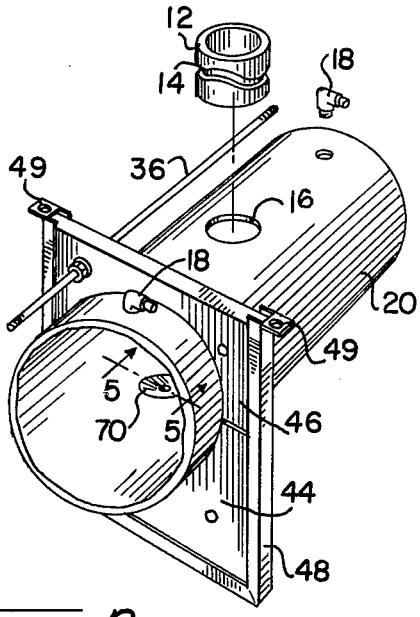
FIG. 2
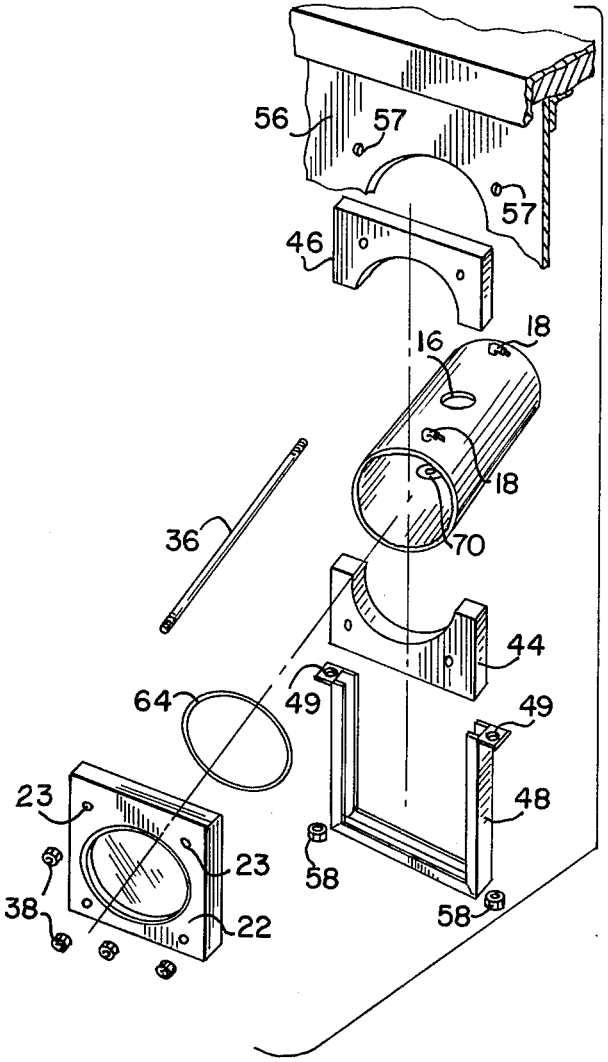
FIG. 4

FREEZE DRYER PARTICULARLY ADAPTED FOR FREEZE DRYING MATERIALS HAVING HIGHLY CORROSIVE VAPORS

BACKGROUND OF THE INVENTION

This application relates to a freeze dryer and, more particularly, to a corrosion-proof freeze drying assembly.

In general, the freeze drying techniques of the prior art provided only the removal of water from a heat-sensitive sample. More recently, however, more and more materials desired to be freeze dried contain corrosive acidic and basic substances. Researchers have continued to use standard freeze dryers for these materials, with resulting corrosion to condensers, chamber and vacuum pumps and heavy repair charges on replacing inaccessible condensers, refrigeration systems and pumps.

Thus, in view of the growing use of exotic chemicals having unknown properties, the need for a truly chemically resistant, totally serviceable freeze dryer has become apparent to researchers. Only when a researcher can perform any freeze drying technique on any material he chooses without undue concern for that material's ability to corrode will the true capabilities of freeze drying be realized.

Certain plastic materials have long been known for their chemically resistant properties. However, until the present invention, certain difficulties have been encountered when attempting to use these plastics to advantage in freeze drying applications. To rigidly support the plastic chamber, welding techniques have been tried, without success, since the weld would expand and contract at different rates than the plastic of the chamber and crack, destroying the weld. In addition, the chamber itself would not have sufficient strength to withstand the high vacuums in use.

SUMMARY OF THE INVENTION

The subject invention fulfills the researcher's need for such a freeze dryer for freeze drying materials having such corrosive vapors. As in conventional freeze dryers, the subject invention includes a sample chamber or compartment and a condenser chamber. Refrigerant fluid is circulated through the condenser chamber to effect a rapid decrease in temperature within the condenser chamber. Meanwhile, the shelves of the sample compartment may be heated to allow the solvent in the sample to easily and gently sublimate under vacuum. The condenser chamber is directly connected to the sample chamber through a wide port to allow the passage of the sublimated vapors. Within the condenser chamber is a condensing coil of titanium wound into a series of coils to circulate the refrigerant fluid in the condenser chamber as described. The cartridge or modular condensing coil is mounted through a rear plate in an appropriately sealed manner, and can be easily removed for inspection or service.

The wall of the condenser chamber is a cylinder of polypropylene, fiberglass or other suitable chemically resistant material which may be spun-molded to achieve an outside diameter of a perfect circle, thereby forming a nearly perfect cylindrical exterior even though having a relatively uneven interior wall. The ability to achieve such close tolerances in the exterior wall of the chamber gives the cylinder an added dimension of strength. Further, this nearly perfect cylindrical exterior shape of the chamber allows the use of an externally mounted brace, closely conforming to the exterior of the chamber, to help withstand the risk of the stress, strain or deformation of the chamber exterior caused by the forces exerted upon the chamber by the vacuum applied. Since the ultimate dry system vacuum achievable in commercial freeze drying assemblies of the type described is five millitorr, the forces exerted on all interior portions of the freeze drying assembly can be considerable. Any weakness present in any of the condenser chamber walls would cause the collapse of those walls upon the application of vacuum. The near-perfect circular shape of the exterior of the condenser chamber of the subject invention, plus the added strength obtainable through the mounting brace, allows it to withstand a maximum force during the application of vacuum and to rigidly mount the chamber to the frame.

To rigidly mount the condenser chamber to the frame and to provide the added support for retaining the spherical structure against the forces of the vacuum and the inherent instability of the inside walls of the chamber, a support mounting is used. This support mounting may comprise two wooden blocks having an over-all rectangular shape, each having one side shaped to fit the exact dimensions of the exterior walls of the chamber. These wooden blocks are encased in a steel channel frame and mounted to the freeze drying structure. The condenser chamber may be attached to the freeze dryer structure by one or more of these support mountings, the method of attachment causing the blocks to tightly retain the chamber in their grasp.

By the use of the above described unique condenser chamber, a chemically resistant condenser chamber capable of extremely high vacuum is made possible. Further, all materials in the condensing system are corrosion resistant.

After the condenser is covered with ice through the sublimation of solvent from the sample in the cooling chamber and subsequent transfer to the condensing chamber, the condenser can be quickly defrosted by reversing the refrigeration cycle and directing hot refrigerant to the coils to melt the ice. This method cannot result in the unsafe condition of thermal runaway, as with electric heaters, and will not eject water vapor into the laboratory, as with a hot air defrost. A drain is provided within the condenser chamber for the convenient removal of liquid condensate.

It is therefore an object of this invention to allow the freeze drying of a multitude of materials without the danger of corrosion of the various freeze dryer elements.

Another object of the subject invention is an easily serviceable freeze dryer with a fully visible condenser chamber.

A further object of the subject invention is a condenser chamber mounting system which adds to the strength of the condenser chamber mounting system.

Still another object of the subject invention is a freeze drying chamber which is impervious to and unaffected by strongly acidic and strongly basic chemical compounds.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein:

FIG. 1 is a perspective view of one embodiment of the freeze dryer of the subject invention;

FIG. 2 is a perspective view of the condenser chamber and chamber mounting of one embodiment of the freeze dryer of the subject invention;

FIG. 4 is an exploded view of one embodiment of the condenser chamber assembly of the subject invention;

FIG. 5 is a cross section taken along the line 5—5 of FIG. 2, showing the drain connection of the condenser chamber of the subject invention;

Referring now to FIG. 1, there is shown the freeze dryer of the subject invention having a sample chamber 10 and a condenser chamber 20. In the freeze dryer shown, both the refrigeration unit 32 and the vacuum pump 30 are housed beneath the condenser chamber 20. Both the refrigeration unit 32 and the vacuum pump 30 are mounted for easy accessibility, with the vacuum motor being mounted on a slide-out shelf to permit the full accessibility for inspection and oil changes. Appropriate gauges and switches are provided for indicating and regulating shelf temperature 42, vacuum level 40, and condenser temperature 38.

Figure 3:
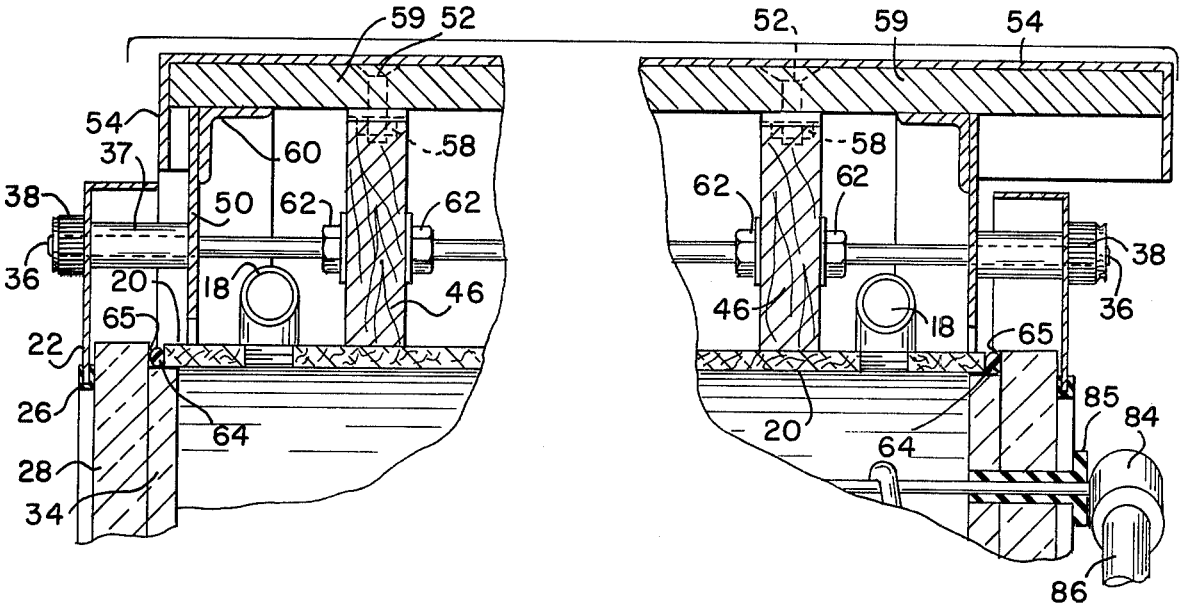
FIG. 3 is a cross-sectional view taken along the line 3—3 of FIG. 1, showing the manner of mounting of the freeze drying chamber to the housing and the sealing arrangement of the door over the condenser chamber.

While the sample chamber shown in FIG. 1 is of the shelf type having a large supporting cabinet, it should be understood that the sample chamber may include any of the various types, such as a manifold having ports for freeze drying a plurality of discrete individual containers simultaneously.

The condenser chamber 20 may be spun-molded from any of the various commercially-available chemically resistant materials, such as polypropylene or fiberglass. This manner of forming the chamber 20 enables a substantially symmetrical cylindrical shape to be attained. While the interior, in contrast to the exterior, remains uneven and imbalanced, this imbalance is negated by both the manner of support and the spherical exterior, as will be explained.

By spin-molding the chamber of a plastic material, significant advantages are gained over those freeze dryers of the prior art. Cylindrical chambers molded in conventional manners would have wall imperfections, both as to size and density of the chamber walls. While these deficient properties may be remedied through expensive materials and methods of manufacture, such a chamber would be prohibitive in terms of cost. Other methods of achieving a suitably strong chamber have used integral reinforcing ribs spaced throughout the chamber walls. However, the ribs tend to restrict drainage of melted condensate and, therefore, impair the necessary act of cleaning the chamber after each use.

The sample chamber communicates with and is directly connected to the condenser chamber 20 by means of a port 16, in a fluid-tight manner, through the use of a rubber grommet or gland 12, having a specially formed groove 14 which fits the contours of the condenser chamber port 16 (FIG. 2). Two elbows 18 communicating with the interiors of the condenser chamber 20 provide a connection to the vacuum pump 30 for a rapid vacuum pull-down.

The condenser chamber 20 is secured to the freeze dryer housing 54 through a support assembly comprising a channel 48 into which fit wooden spacing blocks 44 and 46, forming a collar which exactly accommodates the spherical exterior of the condenser chamber. The wood from which the blocks are formed is preferably plywood or other wood material which is strong and resistant to warping. The use of such wood, which provides the only contact with the frame or housing, makes use of wood's flexibility and insulative properties while providing a support which will not warp, expand or contract with the great temperature differentials encountered in freeze drying. Thus, the support blocks 44 and 46 at all times perform the function of rigidly supporting the condenser chamber 20 and retaining its cylindrical symmetry without the addition of any stress or strain to the chamber during the low temperatures reached during the freeze drying process.

The channel frame 48 has openings 49 into which may be inserted screws 52 attached to the housing 54 and secured in place with appropriate nuts 58 to bias the blocks 44 and 46 against the chamber exterior and rigidly support the chamber. As stated above, while securing the chamber 20 in place, the conformity of the support blocks 44 and 46 to the exterior of the condenser chamber provides additional support to the chamber in resisting the forces exerted upon the chamber walls by the vacuum applied. While this conformity can be achieved by either conforming the blocks to the chamber exterior, or the chamber exterior to the blocks, it is much more practical to form both to within certain exacting tolerances and assure an exact mating of the two surfaces.

The use of wooden blocks in a channel frame overcomes those problems encountered in the prior art practice of welding the plastic chamber to its moorings. No actual joinder of materials, as occurs in a weld, is present. Therefore, perfect agreement of the expansion and contraction rates of the chamber and the support means is not necessary, and will not destroy the support of the chamber within the frame. Since the chamber and frame are not welded to become one integral unit, easier servicing and cleaning is made possible. In fact, modular condenser chambers can be employed, keeping one in use, with a spare in storage for replacing the first, if needed. The entire chamber and support means may be removed in the field, if necessary, for the replacement of the chamber with the spare chamber. Such in-the-field servicing is not possible with the welded units.

The condenser chamber 20 may be enclosed at either end with a transparent cover plate 24, preferably of polycarbonate or acrylic material. As the rear cover plate is substantially identical to the front plate except as noted, reference will be made only to the front cover plate. This cover plate 24 is actually two separate plates 28 and 34 intimately joined together. The interior plate 34 is slightly less in diameter than the exterior plate 28 to allow the placement of an O-ring 64 on the shoulder 65, created by the centrally aligned joinder of the two plates 28 and 34 (FIG. 3).

The combined front cover plates 29 are secured in place by tie rods 36, which secure a sheet metal cover 22 over space washers 37 to the cover plate 29 by thumb nuts 38, thereby fluid-tightly sealing the condenser chamber 20. In tightening the thumb nuts 38 on the tie rods 36, the O-ring is deformed to provide a sufficient vacuum-tight seal for any application. Upon the application of the vacuum, the O-ring 64 is deformed even more for further assurances of a fluid-tight vacuum seal. Tie rods 36 extend through openings 23 in the door 22, through openings 57 in the front housing plate 56 and through openings 61 in the support blocks 46 and 48 and extends to the rear, passing through the openings in the corresponding support blocks, housing the door. For a complete vacuum-tight seal, both the front and rear doors must be tightened by all thumb nuts 38 on the tie rod 36. To more securely hold the support blocks 46 and 48 in place and to provide for an undeviating grasp on the condenser chamber 20, nuts 62 screw onto a threaded portion of a tie rod 36 to firmly position the support blocks at a desired location.

Visibility of the entire chamber is thus made possible throughout the entire freeze drying operation. As the acrylic door windows are thermally nonconductive, no frost forms to block vision during the operation of the condensing coils 24. Room light illuminates the chamber from both front and rear. If additional light is needed, it may be added on the exterior of each door 22, as desired. The windows block no part of the chamber, so the entire condenser chamber may be subject to scrutiny even during a freezing-drying cycle.

For the smaller condenser chambers, it is only necessary that one vacuum support channel be used. This single support channel would preferably be placed on or near the central portion of the condenser chamber 20. However, in the larger embodiments of the subject invention, it would become necessary to use two or more vacuum chamber supports. In the preferred embodiment of the subject invention, two vacuum chamber supports are utilized, with one being place at each end of the vacuum chamber, as shown in FIG. 3.

Figure 6:
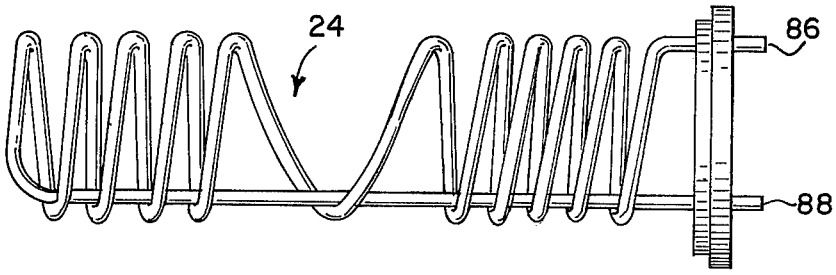
FIG. 6 is a side view of the condenser coils of the subject invention.
Figure 7:
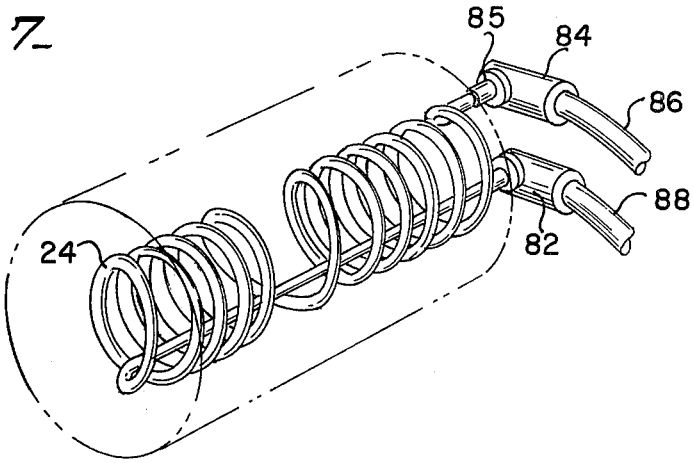
FIG. 7 is a view in perspective of the condenser coils within the condensing chamber of the subject invention shown in relief.

The opposite or rear end of the condenser chamber 20 is also provided with transparent cover plates similar in construction to the front cover plate, as stated above (FIG. 3). The condensing coil inlet and outlet 86 extend through this rear cover plate to the condensing coils 24 within the condenser chamber 20. The condensing coils 24 may be titanium tubing wound into a series of coils (FIG. 6). Sealing grommets 85 preclude a loss of vacuum at the inlet and outlet ports of the condenser coil 24. The refrigeration inlet line 86 and the exhaust line 88 are flexible, having hermetic seals 82 and 84 near the inlet and output ports for minimum heat transfer and vacuum loss to the outside environment at these points (FIG. 7). The refrigerant is expanded directly in the coils 24 for maximum refrigeration capability. The rear of the condenser chamber and the rear cover plate 80 are recessed from the rear of the cabinet housing 54 (FIG. 3) to provide protection for the connection of the refrigeration lines to the condenser coil and allowing the entire freeze dryer to be placed flush with the wall.

On the bottom interior of the condenser chamber 20 is a drain 70 by which the melted condensate may be disposed. The drain 70 includes a circular plug 72 having a tapered edge. The condenser chamber has an opening 71 with a corresponding oppositely tapered edge which admits the tapered plug 72. Formed within the tapered periphery of the plug 72 is a groove, forming a seat 75 where an O-ring 76 may be placed. The plug 72 has an integral threaded stem 77 onto which is screwed a nut 78 to secure the plug 72 within the opening 71. The O-ring 76 assures a fluid-tight vacuum seal about the plug 72. A connecting hose 82 drains the condensate from the plug to an outside disposable site. The connecting hose 82 may be provided with a cock (not shown), or other shut-off valve for retention of the vacuum at times when the drain 70 is not in use.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A condenser chamber adapted for use with a freeze dryer, said condenser chamber spun molded from a chemically resistant material in a generally cylindrical shape and having an exterior wall of any desired diameter, a pair of removable end caps closing said chamber, means mounting said chamber on said freeze dryer, said mounting means supporting the exterior wall of said chamber substantially continuously around the circumference thereof to maintain said chamber in said cylindrical shape under the application of high vacuums to an interior of said chamber, thereby preventing collapse of said chamber.

2. A freeze dryer for use with materials having corrosive vapors, said freeze dryer comprising a sample compartment, a cylindrical condenser chamber, and a housing, said sample compartment communicating with said condenser chamber for the passage of vapors of materials placed within said sample compartment to said chamber upon the application of vacuum, cover plates fluid-tightly secured to the ends of said chamber, a condensing coil in said chamber mounted through one of said plates and connected to a refrigeration unit for cooling the chamber to a desired temperature, said condenser chamber being formed of a chemically resistant plastic material and having a cylindrical exterior wall of a selected diameter, at least one support means conforming closely to said exterior wall of said condenser chamber for attaching said condenser chamber to said housing, said exterior wall being held around its circumference by said support means to maintain said exterior wall of said condenser chamber substantially cylindrical to withstand vacuums as low as five millitorr applied to the interior of said condenser chamber.

3. The freeze dryer of claim 2 wherein said samples are placed on heated shelves within said sample compartment to facilitate the passage of vapors from said samples to said condenser chamber.

4. The freeze dryer of claim 2 wherein each of said transparent covers comprise at least two individual plates forming a seat for a seal which, upon attachment to said cover of said chamber, provides a fluid-tight closure.

5. The freeze dryer of claim 2 wherein said seal comprises an O-ring.

6. The freeze dryer of claim 2 wherein the chemically resistant material is polypropylene.

7. The freeze dryer of claim 2 wherein the chemically resistant material is fiberglass.

8. The freeze dryer of claim 2 wherein the support means comprises an upper block, a lower block and a frame, said upper block and said lower block each having an arcuate surface for closely conforming to said exterior wall of said condenser chamber, said frame retaining said upper block and said lower block in vertical alignment about said condenser chamber when attached to said housing, thereby adding strength to and preventing deformation of said condenser chamber when under vacuum.

9. The freeze dryer of claim 2 wherein said cover plates are transparent acrylic plastic.

* * * * *